US006008168A

United States Patent [19]

Takagi et al.

[11] Patent Number: 6,008,168

[45] Date of Patent: Dec. 28, 1999

[54] EXTREME-PRESSURE AGENT, FRICTION COEFFICIENT MODIFIER, AND FUNCTIONAL FLUIDS

[75] Inventors: Fumiaki Takagi; Kazuaki Abe, both of Sodegaura, Japan

[73] Assignee: Idemitsu Kosan Co., Ltd., Tokyo, Japan

[21] Appl. No.: 08/952,974

[22] PCT Filed: Jun. 7, 1996

[86] PCT No.: PCT/JP96/01557

§ 371 Date: Dec. 8, 1997

§ 102(e) Date: Dec. 8, 1997

[87] PCT Pub. No.: WO96/41851

PCT Pub. Date: Dec. 27, 1996

[30] Foreign Application Priority Data

Jun. 8, 1995 [JP] Japan ..... 7-141555

[51] Int. Cl.[6] ..... C10M 129/68

[52] U.S. Cl. ..... 508/485; 508/465; 252/77; 252/79

[58] Field of Search ..... 508/485

[56] References Cited

U.S. PATENT DOCUMENTS 3,873,464 3/1975 Bieber et al. ..... 252/78

FOREIGN PATENT DOCUMENTS 54-153806 12/1979 Japan .

61-23694 2/1986 Japan .

5-230489 9/1993 Japan .

*Primary Examiner*—Ellen M. McAvoy

*Attorney, Agent, or Firm*—Oblon, Spivak, McClelland, Maier & Neustadt, P.C.

[57] ABSTRACT

An extreme pressure agent and a friction coefficient modifier which comprises a compound having, in a molecule, a group represented by general formula (I):

(I)

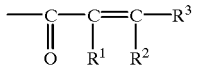

wherein $R^1$, $R^2$, and $R^3$ each represents hydrogen atom or methyl group, and at least one of $R^2$ and $R^3$ represents hydrogen atom; a fluid resistant to seizure under load and a wear resistant fluid which each comprises the above additive or the above modifier; and a flame resistant fluid which comprises a thermally polymerizable substance, preferably the above compound. The extreme pressure agent and the friction coefficient modifier have excellent properties and are advantageously used for lubricating oil, metal working oil, and hydraulic oil. The flame resistant fluid suppresses vaporization of flammable substances by thermal polymerization to prevent fire when the fluid is exposed to a high temperature and is advantageously used as lubricating oil, metal working oil, hydraulic oil, heat treatment oil, and grease.

5 Claims, No Drawings

EXTREME-PRESSURE AGENT, FRICTION COEFFICIENT MODIFIER, AND FUNCTIONAL FLUIDS

TECHNICAL FIELD

The present invention relates to an extreme pressure agent, a friction coefficient modifier, and functional fluids. More particularly, the present invention relates to an extreme pressure agent and a friction coefficient modifier which have excellent properties and are advantageously used for lubricating oil, metal working oil, and hydraulic oil, a fluid resistant to seizure under load and a wear resistant fluid which each comprises the above additive or the above modifier, and a flame resistant fluid which suppresses vaporization of flammable substances by thermal polymerization to prevent fire when the fluid is exposed to a high temperature, eliminates necessity for control of the content of water, facilitates handling and waste disposal, and is advantageously used as lubricating oil, metal working oil, hydraulic oil, washing oil, heat treatment oil, electric insulating oil, and grease.

BACKGROUND ART

Heretofore, lubricating oil is used in driving apparatuses and gears in internal combustion engines, automatic transmissions, dampers, and power steering gears for achieving smooth movement. However, it is known that the lubricating property is insufficient when the apparatuses and gears are used for achieving a high output under a large load. The surface of lubrication is worn out by friction, and seizure finally takes place. Therefore, lubricating oil containing an extreme pressure agent or a wear inhibitor is used. However, conventional extreme pressure agents have problems in that a sufficient effect for preventing seizure is not exhibited because of interaction with other additives, metals are corroded, and wear resistance is inferior, and are not always satisfactory.

As for oil used for metal working, such as cutting, grinding, and deformation processing, improvement in workability has been attempted by adding various types of oiliness improver or extreme pressure agent to mineral oil or synthetic hydrocarbon oil. For example, metal working oils prepared by adding an extreme pressure agent containing sulfur or chlorine to a base oil are commercially available. However, these metal working oils are not always satisfactory with respect to the life of tools and the efficiency of working represented by the precision of a finished surface of a processed material.

Therefore, development of an additive which exhibits the function of improving efficiency of working and decreasing wear of tools by forming a stronger lubricating film has been desired.

Moreover, when a working oil contains a large amount of an extreme pressure agent containing chlorine, there is the possibility that compounds causing environmental hazard (chlorine gas, dioxine, and the like) are formed when waste oil is disposed. Moreover, even when an extreme pressure agent containing sulfur is used, there is the possibility that environmental hazard is caused by the formation of $SO_x$ gas. Therefore, development of an extreme pressure agent which does not cause environmental hazard and has excellent properties has been desired.

A hydraulic fluid is a power transmission fluid which is used for transmission of power, control of force, and buffering in hydraulic systems, such as hydraulic devices and apparatuses, and also has the function of lubrication of sliding parts.

For such a hydraulic fluid, it is essential that the fluid has an excellent resistance to seizure under load and wear resistance as the fundamental properties. Therefore, these properties are provided by addition of an extreme pressure agent and a wear inhibitor to a base oil, such as mineral oil or synthetic oil. However, conventional extreme pressure agents are not always satisfactory in that the wear resistance is insufficient or corrosive wear takes place although the effect of preventing seizure under load is sufficiently exhibited.

For a hydraulic fluid, such as a fluid for traction drive, a relatively high friction coefficient is required in addition to the lubricating property. Therefore, development of an additive which can provide such a property (a friction coefficient modifier) has been desired.

On the other hand, the industry in Japan is placed under various regulations of the Fire Services Act for prevention of fire. For example, many types of lubricating oil are classified as the fourth grade hazardous material and the method of handling in accordance with the place of handling is strictly regulated. It is recommended by the fire department that fire-retarded lubricating oil is used in buildings.

As the fire-retarded lubricating oil, for example, lubricating oils containing a halogen, such as lubricating oils containing chlorine and lubricating oils containing fluorine, lubricating oils containing an ester of phosphoric acid, lubricating oils containing an ester of a fatty acid, and lubricating oils containing water have been developed. Among these lubricating oils, some of the lubricating oils containing a halogen and the lubricating oils containing water show no flash point in the measurement of the flash point of the fourth grade hazardous materials in accordance with the Fire Services Act of Japan. Therefore, these lubricating oils are non-hazardous materials which are not regulated by the Fire Services Act. Particularly, the demand for the lubricating oils containing water has been increasing because these oils show a high degree of safety against fire, and additional equipments for complying with the regulation are not necessary.

However, among the lubricating oils which are classified as the non-hazardous material, the lubricating oils containing chlorine have drawbacks in that the lubricating oils cause corrosion of metals to a great degree, are easily decomposed, form toxic gases by decomposition, and therefore, require careful handling. The lubricating oils containing fluorine are very expensive although these oils are much more stable than the lubricating oils containing chlorine. Therefore, the application of these oils is inevitably limited, and these oils are used only for special applications.

The lubricating oils containing water can generally be classified into W/O oils of the emulsion type (the emulsion type and the solution type), O/W oils of the emulsion type, and water-glycol oils. The problem common to these lubricating oils is an insufficient lubricating property and vaporization of water. Because these lubricating oils contain water, the lubricating property is inevitably inferior. When water is lost by vaporization, the fire-retardant property is also lost, and the oils become hazardous materials having a flash point. Therefore, the content of water must be controlled, and this requires additional man power and cost.

Moreover, a surfactant or a glycol is used so that the oil can contain water. Such an additive shows an adverse effect to sealing materials and coating materials. A lubricating oil of the water-glycol type causes a higher COD (chemical oxygen demand) in the waste water, and there is the possibility of causing an adverse effect to the environment.

Therefore, this lubricating oil has a drawback in that a great cost is required for treatment of waste water.

DISCLOSURE OF THE INVENTION

An object of the present invention is to provide an extreme pressure agent and a friction coefficient modifier which have excellent properties and are advantageously used for lubricating oil, metal working oil, and hydraulic oil. Another object of the present invention is to provide a fluid having excellent resistance to seizure under load and a fluid having a high friction coefficient and excellent wear resistance. Still another object of the present invention is to provide a flame resistant fluid which shows little danger of fire, does not require control of the content of water, and facilitates handling and waste disposal.

As the result of extensive studies conducted by the present inventors to achieve the above objects, it was found that a compound having a specific structure in the molecule has an excellent property as the extreme pressure agent and the friction coefficient modifier and does not cause environmental pollution. It was also found that a fluid containing the above compound or a combination of a base oil and the above compound has excellent resistance to seizure under load and shows a high friction coefficient and excellent wear resistance. It was further found that a fluid containing a thermally polymerizable substance or a combination of a base oil and a thermally polymerizable substance suppresses vaporization of flammable substances by thermal polymerization of the thermally polymerizable substance when the fluid is exposed to a high temperature and can prevent fire. The present invention has been completed based on the above knowledges.

Accordingly, the present invention provides:

(1) An extreme pressure agent which comprises a compound having, in a molecule, a group represented by general formula (I):

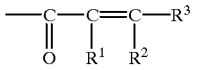

(I)

wherein $R^1$, $R^2$, and $R^3$ each represents hydrogen atom or methyl group, and at least one of $R^2$ and $R^3$ represents hydrogen atom;

(2) A friction coefficient modifier which comprises a compound having a group represented by above general formula (I) in a molecule;

(3) A fluid resistant to seizure under load which has a liquid state or a semi-solid state and comprises a compound having a group represented by above general formula (I) in a molecule;

(4) A wear resistant fluid which has a liquid state or a semi-solid state and comprises a compound having a group represented by above general formula (I) in a molecule;

(5) A fluid resistant to seizure under load or a wear resistant fluid which has a liquid state or a semi-solid state and comprises a base oil and a compound having a group represented by above general formula (I) in a molecule;

(6) A flame resistant fluid which has a liquid state or a semi-solid state and comprises a thermally polymerizable substance;

(7) A flame resistant fluid which has a liquid state or a semi-solid state and comprises a base oil and a thermally polymerizable substance; and (8) A flame resistant fluid described in any of (6) and (7), wherein the thermally polymerizable substance is a compound having a group represented by general formula (I) in a molecule.

THE MOST PREFERRED EMBODIMENT TO CARRY OUT THE INVENTION

The extreme pressure agent and the friction coefficient modifier of the present invention comprises a compound having, in the molecule, a group represented by general formula (I):

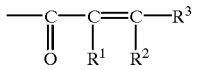

(I)

In above general formula (I), $R^1$, $R^2$, and $R^3$ each represents hydrogen atom or methyl group, and at least one of $R^2$ and $R^3$ represents hydrogen atom. When $R^2$ and $R^3$ both represent methyl groups, the property as the extreme pressure agent or as the friction coefficient modifier is insufficient. The group represented by general formula (I) may be contained singly or in a plurality of numbers in a molecule.

The structure of the compound other than the group represented by general formula (I) can be selected from structures having various molecular weights in accordance with application. Examples of the compound having the group represented by general formula (I) include polyethylene glycol diacrylate, polyethylene glycol dimethacrylate, hydroxypivalic acid neopentyl glycol ester diacrylate modified with caprolactone, hydroxypivalic acid neopentyl glycol ester dimethacrylate modified with caprolactone, 2,2-bis(4-ethyleneglycoxyphenyl)propane diacrylate, 2,2-bis(4-ethyleneglycoxyphenyl)propane dimethacrylate, 2,2-bis(4-polyethyleneglycoxyphenyl)propane diacrylate, 2,2-bis(4-polyethyleneglycoxyphenyl)propane dimethacrylate, tris (propylene glycol acrylate) glycerol ether, tris (polypropylene glycol acrylate) glycerol ether, trimethylolpropane (ethylene glycol acrylate) ether, trimethylolpropane (polyethylene glycol acrylate) ether, trimethylolpropane (ethylene glycol methacrylate) ether, trimethylolpropane (polyethylene glycol methacrylate) ether, dipentaerythritol acrylate, dipentaerythritol methacrylate, dipentaerythritol acrylate modified with caprolactone, and dipentaerythritol methacrylate modified with caprolactone. Among these compounds, compounds having a functionality index of 0.01 to 1.7, preferably 0.05 to 1.7, more preferably 0.1 to 1.0, are advantageously used. The functionality index is defined as follows:

functionality index=(average number of functional group in a molecule/average molecular weight of compound)×100

In the above definition, the number of functional group is the number of the group represented by general formula (I).

The extreme pressure agent and the friction coefficient modifier of the present invention which comprise the above compound do not contain chlorine atom or sulfur atom. Therefore, the extreme pressure agent and the friction coefficient modifier do not cause environmental pollution, have an excellent load-bearing property, increase the friction coefficient, show excellent effect of providing wear resistance, and are advantageously used for lubricating oil, metal working oil (such as cutting oil, grinding oil, and deformation processing oil), and hydraulic oil.

The fluid resistant to seizure under load and the wear resistant fluid of the present invention contain an additive comprising a compound having the group represented by above general formula (I) in the molecule and, where necessary, a base oil. The fluids may contain a single type of the additive or two or more types of the additive.

The fluid resistant to seizure under load and the wear resistant fluid are advantageously used, for example, as lubricating oil, metal working oil (such as cutting oil, grinding oil, and deformation processing oil), and hydraulic oil. Because these fluids have a high friction coefficient and excellent wear resistance, these fluids are advantageously used as lubricating oil, metal working oil (such as cutting oil, grinding oil, and deformation processing oil), and hydraulic oil which require a high friction coefficient and excellent wear resistance, and particularly advantageously used as metal working oil and hydraulic oil, such as a fluid for traction drive.

The content of the above compound in the fluids is not particularly limited and suitably selected in accordance with the situation. The content is generally 0.1% by weight or more, preferably 0.5% by weight or more.

The base oil which optionally used in the above fluid resistant to seizure under load and the above wear resistant fluid is not particularly limited and suitably selected from mineral oils and synthetic oils in accordance with the object and the conditions of application. Examples of the mineral oil include distillates obtained by atmospheric distillation of paraffinic crude oil, intermediate crude oil, or naphthenic crude oil, distillates obtained by vacuum distillation of a residue of atmospheric distillation, and refined oils obtained by refining these oils in accordance with a conventional process. Specific examples of the mineral oil include oils refined with a solvent, hydro-refined oils, dewaxed oils, and oils treated with clay.

Examples of the synthetic oil include low molecular weight polybutene; low molecular weight polypropylene; oligomers of α-olefins having 8 to 14 carbon atoms; hydrogenation products of these oligomers; ester compounds, such as polyol esters such as fatty acid esters of trimethylolpropane and fatty acid esters of pentaerythritol, esters of dibasic acids, esters of aromatic polycarboxylic acids, and esters of phosphoric acid; alkylaromatic compounds, such as alkylbenzenes and alkylnaphthalenes; and silicone oils.

The base oil may be used singly or as a suitable combination of two or more types.

The fluid resistant to seizure under load and the wear resistant fluid may additionally comprise at least one member selected from antioxidants and polymerization inhibitors to increase stability and life, where desired.

Examples of the antioxidant include phenolic antioxidants, such as pentaerythritol tetrakis[3-(3,5-di-t-butylhydroxyphenyl) propionate], tris(3,5-di-t-butyl-4-hydroxyphenyl) isocyanurate, and 2,2'-methylene bis(4-ethyl-6-t-butylphenol); amine antioxidants, such as N-phenyl-α-naphthylamine, dialkyldiphenylamines, and N-(p-t-octylphenyl)-1-naphthylamine; and antioxidants containing sulfur, such as phenothiazine. The polymerization inhibitor is a compound which inhibits or suppresses polymerization, such as hydroquinones and methoxyphenols. These compounds may be used singly or as a combination of two or more types. The amount of these compounds used is different in accordance with the object and the conditions of application and is preferably 100 ppm or more based on the total amount of the fluid.

The flame resistant fluid of the present invention is a fluid comprising a thermally polymerizable substance and may have a liquid state or a semi-solid state. When the fluid of the present invention is exposed to a high temperature which may cause fire, the thermally polymerizable substance is polymerized by the heat, and the danger of fire is decreased by suppressing vaporization of flammable substances. It is also possible that a fluid comprising a compound which is polymerized during the measurement of the flash point and showing no flash point is prepared as the flame resistant fluid of the present invention. Such a fluid is treated as the non-hazardous substance in accordance with the Fire Services Act of Japan. Moreover, it is important in the flame resistant fluid of the present invention that the temperature of initiation of polymerization is higher than a service temperature. The "service temperature" of an oil in the present specification means the maximum temperature of the oil, such as lubricating oil, in the range of normal use. The range of normal use includes random variations in the temperature. For example, the service temperature of a hydraulic oil is the temperature at the outlet of a hydraulic pump. When the temperature of initiation of polymerization is lower than the service temperature, there is the possibility that polymer is formed during use to cause difficulty in the use. From the standpoint of preventing polymerization during use, the temperature of initiation of polymerization is higher than the service temperature preferably by 10° C. or more, more preferably by 20° C. or more. It is desirable that the temperature of initiation of polymerization is lower than the flash point of flammable substances in the fluid preferably by 10° C. or more, more preferably by 20° C. or more, so that the polymerization can be completed before the fluid catches fire, and vaporization of the flammable substances is suppressed. However, even when the fluid might catch fire before the polymerization is completed, the completion of the polymerization which follows catching fire suppresses vaporization of the flammable substances, prevents continued fire, and thus decreases danger of fire.

In the flame resistant fluid of the present invention, when the thermally polymerizable substance itself is a fluid having a liquid state or a semi-solid state, it is not necessary that a base oil is used in combination depending on the application. The thermally polymerizable substance may be used in combination with a base oil, where necessary. When these components are used in combination, it is preferable that the relative amount of these components is suitably selected in the range in which the obtained fluid does not have a flash point.

In the present invention, the viscosity of the fluid having a liquid state is not particularly limited. The fluid generally has a kinematic viscosity of 1 to 50 cSt at 100° C. and 10 to 400 cSt at 40° C., preferably 1 to 30 cSt at 100° C. and 20 to 200 cSt at 40° C.

Preferable examples of the thermally polymerizable substance used in the flame resistant fluid of the present invention include compounds having the group represented by general formula (I) described above in the molecule. When $R^2$ and $R^3$ in general formula (I) both represent methyl groups, the compound has a small polymerizability, and there is the possibility that polymerization does not take place sufficiently in emergency, and flammable substances are vaporized to cause fire. The group represented by general formula (I) may be contained singly or in a plurality of numbers in a molecule.

Examples of the compound having the group represented by general formula (I) which is used as the thermally polymerizable substance in the flame retarded fluid of the present invention include the same compounds described above as the examples of the compounds used as the extreme pressure agent and the friction coefficient modifier. Among these compounds, compounds having a molecular weight of 200 or more is preferable. When a compound having a molecular weight less than 200 is exposed to a high temperature, there is the possibility that the compound is vaporized before thermal polymerization takes place and catches fire, and such a compound is not preferable.

In the flame resistant fluid of the present invention, the thermally polymerizable substance may be used singly or as a combination of two or more types.

The flame resistant fluid of the present invention comprises the above thermally polymerizable substance and, where necessary, a base oil, and is advantageously used, for example, as lubricating oil, metal working oil, such as cutting oil, grinding oil, and deformation processing oil, hydraulic oil, washing oil, heat treatment oil, electric insulating oil, and grease. The content of the thermally polymerizable substance in the flame resistant fluid is not particularly limited and suitably selected in accordance with the situation. The content is generally 15% by weight or more, preferably 25% by weight or more.

The base oil used in the flame resistant oil in accordance with necessity is not particularly limited and suitably selected from mineral oils, synthetic oils, and solvents in accordance with the object and the conditions of use. Examples of the base oil include oils of polyalkylene glycols (PAG), oils of silicic acid esters, oils of carbonic acid esters, oils of carbamates, oils containing nitrogen, and oils containing halogens in addition to the oils described above as the examples of the base oil contained in the fluid resistant to seizure under load and the wear resistant fluid. When the flame resistant oil is used at a place having a great possibility of fire, a base oil having a relatively high flash point is preferably used. Specifically, a base oil having a flash point of 100° C. or more is advantageously used, and a base oil having a flash point of 200° C. or more is more advantageously used. The base oil may be used singly or as a combination of two or more types.

In the flame resistant fluid of the present invention, at least one member selected from antioxidants and polymerization inhibitors may be comprised in accordance with desire for the purpose of enhancing stability and increasing life. Examples of the antioxidant and the polymerization inhibitor include the same compounds described above as the examples of the antioxidant and the polymerization inhibitor used for the fluid resistant to seizure under load and the wear resistant fluid. The antioxidant and the polymerization inhibitor may be used singly or as a combination of two or more types. The used amount is different depending on the object and the conditions of use and preferably 100 ppm by weight or more based on the total amount by weight of the flame resistant fluid.

It is preferable in the flame resistant fluid of the present invention that the temperature showing a decrease in weight of 10% is higher than the starting temperature of an exothermic curve (the exothermic curve by polymerization) in the differential thermal analysis (TG/DTA). The starting temperature of an exothermic curve is the temperature at which heat of polymerization is measured. Therefore, the above description means that the polymerization preferably starts before the decrease in weight of the fluid reaches 10%. It is preferable that the decrease in weight of the fluid before the start of polymerization is kept below 10% to decrease the possibility of fire. When it is considered that there are various degrees in the easiness to catch fire, it is more preferable that the decrease in weight of the fluid is kept below 5%. The differential thermal analysis is conducted under the conditions: in an air :stream of a flow rate of 300 ml/minute, a rate of increasing temperature of 10° C., using a pan of platinum, and a sample in an amount of 8 mg.

The flame resistant fluid of the present invention exhibits the ordinary functions completely under the normal conditions of use. When the fluid is exposed to a high temperature which is abnormally higher than the normal temperature of use and the possibility of fire arises, the polymerization takes place by the heat. As the result, vaporization of flammable substances is suppressed, and the effect of decreasing the possibility of fire is exhibited. The flame resistant fluid of the present invention has such an excellent flame retarding property that the possibility of pin-hole fire is eliminated. Moreover, troublesome control of the content of water required for a flame resistant fluid containing water is not necessary because water is not used. The flame resistant fluid of the present invention has an excellent lubricating property, and treatment of the waste water is easy. It is possible that a flame resistant fluid showing no flash point is prepared as the flame resistant fluid of the present invention. This fluid is treated as the non-hazardous substance in accordance with the Fire Services Act of Japan.

The fluid resistant to seizure under load, the wear resistant fluid, and the flame resistant fluid of the present invention may suitably comprise various additives, such as corrosion inhibitors, viscosity index improvers, other extreme pressure agents, mist preventing agents, ultraviolet light absorbers, and flame retardants, in addition to the antioxidant and the polymerization inhibitor in accordance with the object of use, where desired.

Examples of the corrosion inhibitor include alkyl- or alkenylsuccinic acid, sorbitan monooleate, pentaerythritol mono- or dioleate, amine phosphate, and benzotriazole. Examples of the viscosity index improver include polymethacrylates, polyisobutylene, and polyalkylstyrenes. Examples of other extreme pressure agent include zinc dialkyldithiophosphates, dialkyl polysulfides, triaryl phosphates, and trialkyl phosphates. Examples of the mist preventing agent include polyolefins, polyacrylates, polymethacrylates, polyalkylene glycols, polyalkylene glycol alkyl ethers, styrene-olefin copolymers, styrene-maleic acid ester copolymers, and polyesters.

Examples of the ultraviolet light absorber include salicylic acid ultraviolet light absorbers, such as phenyl salicylate and butyl salicylate; benzophenone ultraviolet light absorbers, such as 2,4-dihydroxy-benzophenone and 2-hydroxy-4-methoxybenzophenone; benzotriazole ultraviolet light absorbers, such as 1,3,5-benzotriazole and 2-(2-hydroxy-5-methylphenyl)benzotriazole; and cyanoacrylate ultraviolet light absorbers. As the flame retardant, for example, flame retardants containing a halogen and flame retardants containing phosphorus may be used, but it is preferable that addition of these flame retardants are avoided as much as possible because of the adverse effect to the environment.

The present invention is described in more detail with reference to examples in the following. However, these examples are not to be construed to limit the scope of the present invention.

The abbreviations used for the components are described in the following;

(1) Polymerizable compounds

- compound A: hydroxypivalic acid neopentyl glycol diacrylate modified with caprolactone (average molecular weight: 540)
- compound B: hydroxypivalic acid neopentyl glycol diacrylate modified with caprolactone (average molecular weight: 768)
- compound C: polyethylene glycol diacrylate (average molecular weight: 522)
- compound D: tris(polypropylene glycol acrylate) glycerol ether (average molecular weight: 463)
- compound E: tris(polyethylene glycol acrylate) trimethylolpropane ether (average molecular weight: 428)

compound F: tris(polypropylene glycol acrylate) trimethylolpropane ether (average molecular weight: 470)

compound G: a hydroxypivalic acid neopentyl glycol di(acrylate, 2-ethylhexanoate) mixture modified with caprolactone compound H: trimethylolpropane (diisostearate) monoacrylate compound I: trimethylolpropane (di-2-ethylhxanoate) monoacrylate compound J: trimethylolpropane (isostearate) (2-ethylhexanoate) monoacrylate compound K: pentaerythritol (diisostearate) diacrylate compound L: pentaerythritol (triisostearate) monoacrylate compound M: pentaerythritol (diisostearate) (2-ethylhexanoate) monoacrylate compound N: pentaerythritol (isostearate) (2-ethylhexanoate) diacrylate compound O: pentaerythritol (tri-2-ethylhexanoate) monoacrylate (2) Base oils base oil A: a trimethylolpropane tri(oleate, isostearate) mixture base oil B: (2,2-dimethyl-3-hydroxypropyl 2',2'-dimethyl-3'-hydroxypropionate) diisostearate base oil C: a (2,2-dimethyl-3-hydroxypropyl 2',2'-dimethyl-3'-hydroxypropionate) di(isostearate, oleate) mixture base oil D: a tri(2-ethylhexyl, lauryl) trimellitate mixture base oil E: a pentaerythritol tetra(caproate, nonanoate) mixture base oil F: a trimethylolpropane tri(2-ethylhexanoate, isostearate) mixture base oil G: a pentaerythritol tri(2-ethylhexanoate, oleate) mixture base oil H: trimethylpropane trioleate base oil I: 1,2,4-triisononyl trimellitate base oil J: HG-500 (mineral oil, 500 neutral grade)

base oil K: a pentaerythritol (2-ethylhexanoate, isostearate) mixture (3) Additives additive A: p-methoxyphenol additive B: 2,2'-methylenebis(4-ethyl-6-t-butylphenol)

additive C: N-phenyl-α-naphthylamine additive D: pentaerythritol tetrakis[3-(3,5-di-t-butyl-4-hydroxyphenyl)propionate]

EXAMPLE 1

Flame resistant fluids having the compositions shown in the Formulation Examples in Table 1 were prepared. The kinematic viscosity of the prepared fluids were measured, and the test of flame retardation was conducted in accordance with the following methods:

(Test of flame retardation)

Into a porcelain crucible (outer diameter×height: 53 mm×43 mm, volume: 50 ml), 10 ml (at a room temperature) of a sample was placed. A metal piece (SUS 315, 10 g) heated to 900° C. by a gas burner was thrown into the sample, and ignition and flame retardation of the sample were evaluated.

The result was shown by a mark ◎ when the sample was not ignited; a mark ○ when the fire was self-extinguished within 20 seconds; and a mark X when the fire continued for more than 20 seconds.

In Comparative Examples, the following materials were used:

Comparative Example 1: mineral oil (150 neutral grade)

Comparative Example 2: PEG #400 (polyethylene glycol #400)

Comparative Example 3: PAO [a poly-α-olefin (decene oligomer), viscosity grade 47]

TABLE 1-1

| Formulation Example | 1 | 2 | 3 | 4 |
|---|---|---|---|---|
| composition | | | | |
| polymerizable compound | | | | |
| type | compound A | compound A | compound A | compound A |
| amount (% by wt.) | 99.99 | 99.50 | 99.00 | 98.00 |
| base oil | | | | |
| type | — | — | — | — |
| amount (% by wt.) | — | — | — | — |
| additive | | | | |
| type | additive A | additive A | additive A | additive A |
| amount (% by wt.) | 0.01 | 0.50 | 1.00 | 2.00 |
| kinematic viscosity at 40° C. (cSt) | 45.22 | 45.40 | 46.24 | 46.55 |
| flame retardation | ◎ | ◎ | ○ | ○ |

TABLE 1-2

| Formulation Example | 5 | 6 | 7 | 8 |
|---|---|---|---|---|
| composition | | | | |
| polymerizable compound | | | | |
| type | compound A | compound A | compound A | compound A |
| amount (% by wt.) | 99.80 | 99.80 | 99.80 | 69.00 |
| base oil | | | | |
| type | — | — | — | base oil A |
| amount (% by wt.) | — | — | — | 30.00 |
| additive | | | | |
| type | additive B | additive C | additive D | additive C |
| amount (% by wt.) | 0.20 | 0.20 | 0.20 | 1.00 |
| kinematic viscosity at 40° C. (cSt) | 46.30 | 45.35 | 45.80 | 50.96 |
| flame retardation | ◎ | ◎ | ◎ | ◎ |

TABLE 1-3

| Formulation Example | 9 | 10 | 11 | 12 |
|---|---|---|---|---|
| composition | | | | |
| polymerizable compound | | | | |
| type | compound A | compound A | compound A | compound A |
| amount (% by wt.) | 49.00 | 69.00 | 69.00 | 69.90 |
| base oil | | | | |
| type | base oil A | base oil B | base oil C | base oil D |
| amount (% by wt.) | 50.00 | 30.00 | 30.0 | 30.0 |
| additive | | | | |
| type | additive C | additive D | additive D | additive C |
| amount (% by wt.) | 1.00 | 1.00 | 1.00 | 0.10 |
| kinematic viscosity at 40° C. (cSt) | 53.76 | 49.05 | 41.32 | 52.39 |
| flame retardation | ○ | ○ | ○ | ◎ |

TABLE 1-4

| Formulation Example | 13 | 14 | 15 | 16 |
|---|---|---|---|---|
| composition | | | | |
| polymerizable compound | | | | |
| type | compound A | compound A | compound A | compound A |
| amount (% by wt.) | 69.80 | 69.90 | 69.80 | 69.90 |
| base oil | | | | |
| type | base oil E | base oil F | base oil G | base oil H |
| amount (% by wt.) | 30.00 | 30.00 | 30.00 | 30.00 |
| additive | | | | |
| type | additive A | additive C | additive B | additive C |
| amount (% by wt.) | 0.20 | 0.10 | 0.20 | 0.10 |
| kinematic viscosity at 40° C. (cSt) | 43.90 | 44.62 | 49.28 | 46.10 |
| flame retardation | ○ | ○ | ◎ | ◎ |

TABLE 1-7

| Formulation Example | 25 | 26 | 27 | 28 |
|---|---|---|---|---|
| composition | | | | |
| polymerizable compound | | | | |
| type | compound C | compound C | compound C | compound C |
| amount (% by wt.) | 99.00 | 99.00 | 69.00 | 48.00 |
| base oil | | | | |
| type | — | — | base oil E | base oil F |
| amount (% by wt.) | — | — | 30.00 | 50.00 |
| additive | | | | |
| type | additive C | additive D | additive C | additive A |
| amount (% by wt.) | 1.00 | 1.00 | 1.00 | 2.00 |
| kinematic viscosity at 40° C. (cSt) | 24.90 | 24.60 | 28.43 | 32.25 |
| flame retardation | ○ | ○ | ○ | ○ |

TABLE 1-8

| Formulation Example | 29 | 30 | 31 | 32 |
|---|---|---|---|---|
| composition | | | | |
| polymerizable compound | | | | |
| type | compound C | compound D | compound D | compound D |
| amount (% by wt.) | 68.50 | 99.00 | 99.00 | 99.50 |
| base oil | | | | |
| type | base oil G | — | — | — |
| amount (% by wt.) | 30.00 | — | — | — |
| additive | | | | |
| type | additive A | additive A | additive B | additive C |
| amount (% by wt.) | 1.50 | 1.00 | 1.00 | 0.50 |
| kinematic viscosity at 40° C. (cSt) | 31.53 | 30.99 | 31.55 | 31.75 |
| flame retardation | ○ | ○ | ○ | ○ |

40

TABLE 1-9

| Formulation Example | 33 | 34 | 35 | 36 |
|---|---|---|---|---|
| composition | | | | |
| polymerizable compound | | | | |
| type | compound D | compound D | compound D | compound D |
| amount (% by wt.) | 99.00 | 69.50 | 69.00 | 69.50 |
| base oil | | | | |
| type | — | base oil E | base oil F | base oil F |
| amount (% by wt.) | — | 30.00 | 30.00 | 30.00 |
| additive | | | | |
| type | additive D | additive C | additive A | additive C |
| amount (% by wt.) | 1.00 | 0.50 | 1.00 | 0.50 |
| kinematic viscosity at 40° C. (cSt) | 31.70 | 33.63 | 33.92 | 34.15 |
| flame retardation | ○ | ○ | ○ | ○ |

TABLE 1-10

| Formulation Example | 37 | 38 | 39 | 40 |
|---|---|---|---|---|
| composition | | | | |
| polymerizable compound | | | | |
| type | compound E | compound E | compound E | compound E |
| amount (% by wt.) | 99.99 | 99.50 | 99.00 | 99.00 |
| base oil | | | | |
| type | — | — | — | — |
| amount (% by wt.) | — | — | — | — |
| additive | | | | |
| type | additive A | additive B | additive C | additive D |
| amount (% by wt.) | 0.01 | 0.50 | 1.00 | 1.00 |
| kinematic viscosity at 40° C. (cSt) | 27.89 | 28.10 | 27.94 | 27.90 |
| flame retardation | ⊚ | ○ | ○ | ○ |

TABLE 1-11

| Formulation Example | 41 | 42 | 43 | 44 |
|---|---|---|---|---|
| composition | | | | |
| polymerizable compound | | | | |
| type | compound F | compound F | compound F | compound F |
| amount (% by wt.) | 99.00 | 99.50 | 99.90 | 99.00 |
| base oil | | | | |
| type | — | — | — | — |
| amount (% by wt.) | — | — | — | — |
| additive | | | | |
| type | additive A | additive B | additive C | additive D |
| amount (% by wt.) | 1.00 | 0.50 | 0.10 | 1.00 |
| kinematic viscosity at 40° C. (cSt) | 32.61 | 32.50 | 32.49 | 32.66 |
| flame retardation | ○ | ○ | ○ | ○ |

TABLE 1-12

| Formulation Example | 45 | 46 | 47 |
|---|---|---|---|
| composition | | | |
| polymerizable compound | | | |
| type | compound F | compound F | compound F |
| amount (% by wt.) | 79.80 | 69.00 | 69.00 |
| base oil | | | |
| type | base oil E | base oil F | base oil H |
| amount (% by wt.) | 20.00 | 30.00 | 30.00 |

TABLE 1-12-continued

| Formulation Example | 45 | 46 | 47 |
|---|---|---|---|
| additive | | | |
| type | additive D | additive A | additive A |
| amount (% by wt.) | 0.20 | 1.00 | 1.00 |
| kinematic viscosity at 40° C. (cSt) | 34.10 | 35.59 | 36.53 |
| flame retardation | ○ | ○ | ○ |

TABLE 1-13

| Formulation Example | 48 | 49 | 50 | 51 |
|---|---|---|---|---|
| composition | | | | |
| polymerizable compound | | | | |
| type | compound G | compound H | compound I | compound J |
| amount (% by wt.) | 99.99 | 99.99 | 99.99 | 99.99 |
| base oil | | | | |

TABLE 1-13-continued

| Formulation Example | 48 | 49 | 50 | 51 |
|---|---|---|---|---|
| type | — | — | — | — |
| amount (% by wt.) | — | — | — | — |
| additive | | | | |
| type | additive A | additive A | additive A | additive A |
| amount (% by wt.) | 0.01 | 0.01 | 0.01 | 0.01 |
| kinematic viscosity at 40° C. (cSt) | 117.91 | 106.74 | 64.04 | 59.45 |
| flame retardation | ◎ | ◎ | ◎ | ◎ |

TABLE 1-14

| Formulation Example | 52 | 53 | 54 | 55 |
|---|---|---|---|---|
| composition | | | | |
| polymerizable compound | | | | |
| type | compound K | compound L | compound M | compound N |
| amount (% by wt.) | 99.99 | 99.99 | 99.99 | 99.99 |
| base oil | | | | |
| type | — | — | — | — |
| amount (% by wt.) | — | — | — | — |
| additive | | | | |
| type | additive A | additive A | additive A | additive A |
| amount (% by wt.) | 0.01 | 0.01 | 0.01 | 0.01 |
| kinematic viscosity at 40° C. (cSt) | 168.51 | 133.47 | 104.60 | 122.02 |
| flame retardation | ◎ | ◎ | ◎ | ◎ |

TABLE 1-15

| Formulation Example | 56 | 57 | 58 | 59 |
|---|---|---|---|---|
| composition | | | | |
| polymerizable compound | | | | |
| type | compound O | compound N | compound N | compound L |
| amount (% by wt.) | 99.99 | 99.50 | 99.00 | 69.99 |
| base oil | | | | |
| type | — | — | — | base oil I |
| amount (% by wt.) | — | — | — | 30.00 |
| additive | | | | |
| type | additive A | additive C | additive D | additive A |
| amount (% by wt.) | 0.01 | 0.50 | 1.00 | 0.01 |
| kinematic viscosity at 40° C. (cSt) | 127.30 | 123.88 | 124.20 | 119.50 |
| flame retardation | ◎ | ◎ | ◎ | ◎ |

TABLE 1-16

| Formulation Example | 60 | 61 | 62 | 63 |
|---|---|---|---|---|
| composition | | | | |
| polymerizable compound | | | | |
| type | compound L | compound L | compound L | compound N |

TABLE 1-16-continued

| Formulation Example | 60 | 61 | 62 | 63 |
|---|---|---|---|---|
| amount (% by wt.) | 69.50 | 84.50 | 69.50 | 69.99 |
| base oil | | | | |
| type | base oil I | base oil J | base oil K | base oil I |
| amount (% by wt.) | 30.00 | 15.00 | 30.00 | 30.00 |
| additive | | | | |
| type | additive C | additive C | additive C | additive A |
| amount (% by wt.) | 0.50 | 0.50 | 0.50 | 0.01 |
| kinematic viscosity at 40° C/ (cSt) | 117.07 | 125.18 | 120.73 | 110.10 |
| flame retardation | ◎ | ○ | ◎ | ◎ |

TABLE 1-17

| Formulation Example | 64 | 65 | 66 | 67 |
|---|---|---|---|---|
| composition | | | | |
| polymerizable compound | | | | |
| type | compound N | compound N | compound N | compound B |
| amount (% by wt.) | 59.50 | 79.50 | 49.50 | 39.80 |
| base oil | | | | |
| type | base oil I | base oil J | base oil K | base oil I |

TABLE 1-17-continued

| Formulation Example | 64 | 65 | 66 | 67 |
|---|---|---|---|---|
| amount (% by wt.) | 40.00 | 20.00 | 50.00 | 60.00 |
| additive | | | | |
| type | additive C | additive C | additive C | additive C |
| amount (% by wt.) | 0.50 | 0.50 | 0.50 | 0.20 |
| kinematic viscosity at 40° C. (cSt) | 105.35 | 114.62 | 123.49 | 90.05 |
| flame retardation | ◎ | ○ | ◎ | ◎ |

TABLE 1-18

| Formulation Example | 68 | 69 | 70 |
|---|---|---|---|
| composition | | | |
| polymerizable compound | | | |
| type | compound D | compound D | compound B |
| amount (% by wt.) | 39.30 | 29.10 | 34.00 |
| base oil | | | |
| type | base oil D | base oil D | base oil A/ base oil D |
| amount (% by wt.) | 60.00 | 70.00 | 60.00/5.00 |
| additive | | | |
| type | additive C | additive C | additive C |
| amount (% by wt.) | 0.70 | 0.90 | 1.00 |
| kinematic viscosity at 40° C. (cSt) | 51.49 | 56.40 | 88.34 |
| flame retardation | ◎ | ◎ | ◎ |

TABLE 1-19

| Comparative Example | 1 | 2 | 3 |
|---|---|---|---|
| composition | | | |
| polymerizable compound | | | |
| type | — | — | — |
| amount (% by wt.) | — | — | — |
| base oil | | | |
| type | mineral oil | PEG #400 | PAO |
| amount (% by wt.) | 100.00 | 100.00 | 100.00 |
| additive | | | |
| type | — | — | — |
| amount (% by wt.) | — | — | — |
| kinematic viscosity at 40° C. (cSt) | 32.15 | 41.55 | 46.86 |
| flame retardation | x | x | x |

EXAMPLE 2

Flame resistant fluids having the compositions selected as shown in Table 2 from the Formulation Examples shown in Table 1 were used. The differential thermal analysis (TG/DTA) of the flame resistant fluid was conducted in the following condition, and the starting temperature of an exothermic curve and the temperature showing a decrease in weight of 10% were obtained. The results are shown in Table 2.

(Differential thermal analysis)

apparatus: TG/DTA 300, a product of SEIKO DENSHI KOGYO Co., Ltd.

pan: a vessel for a sample made of platinum atmospheric gas: a stream of air; flow rate: 300 ml/minute rate of increasing temperature: 10° C./minute temperature range of measurement: room temperature to 600° C.

The flash point of the above flame resistant fluids was measured in accordance with the method of Fire Services Act of Japan (An open Cleveland method, Japanese Industrial Standard K-2265). The results are also shown in Table 2.

TABLE 2

| | starting temperature of exothermic curve (°C.) | temperature of 10% decrease in weight (°C.) | flash point (COC) (°C.) |
|---|---|---|---|
| Formulation Example 1 | 188.0 | 309.4 | none* |
| Formulation Example 9 | 154.4 | 266.8 | none* |
| Formulation Example 10 | 229.6 | 245.9 | none* |
| Formulation Example 11 | 185.3 | 279.3 | none* |
| Formulation Example 17 | 190.0 | 336.5 | none* |
| Formulation Example 18 | 230.8 | 285.0 | none* |
| Formulation Example 20 | 230.0 | 284.0 | none* |
| Formulation Example 23 | 175.1 | 310.0 | none* |
| Formulation Example 24 | 188.2 | 318.8 | none* |
| Formulation Example 25 | 212.1 | 309.2 | none* |
| Formulation Example 26 | 162.5 | 320.9 | none* |
| Formulation Example 30 | 189.4 | 314.0 | none* |
| Formulation Example 31 | 213.9 | 270.5 | none* |
| Formulation Example 32 | 222.2 | 253.9 | none* |
| Formulation Example 33 | 193.4 | 258.4 | none* |
| Formulation Example 34 | 236.5 | 268.3 | none* |
| Formulation Example 35 | 198.2 | 271.1 | none* |
| Formulation Example 36 | 228.1 | 263.6 | none* |
| Formulation Example 37 | 169.0 | 331.0 | none* |
| Formulation Example 38 | 217.9 | 244.8 | none* |
| Formulation Example 40 | 195.8 | 308.7 | none* |
| Formulation Example 42 | 219.0 | 240.3 | none* |
| Formulation Example 46 | 198.9 | 322.8 | none* |
| Formulation Example 53 | 173.0 | 311.4 | none* |
| Formulation Example 55 | 174.8 | 321.2 | none* |
| Formulation Example 57 | 190.5 | 302.8 | none* |
| Formulation Example 59 | 214.4 | 292.9 | none* |
| Formulation Example 60 | 242.3 | 290.5 | none* |
| Formulation Example 63 | 204.4 | 297.5 | none* |
| Formulation Example 64 | 245.5 | 295.6 | none* |
| Formulation Example 67 | 240.0 | 281.5 | none* |
| Formulation Example 68 | 239.7 | 286.0 | none* |
| Formulation Example 69 | 212.1 | 309.2 | none* |
| Formulation Example 70 | 256.4 | 298.6 | none* |

*Hardened during the measurement (no flash point)

EXAMPLE 3

Flame resistant fluids having the compositions selected as shown in Table 3 from the Formulation Examples shown in Table 1 were used. The test of heat stability of the flame resistant fluids was conducted at 150° C. in accordance with the following method. The results are shown Table 3.

(Test of heat stability)

Into a 100 ml sample bottle, 10 g of a sample was placed. The sample bottle was dipped into an oil pan of 150° C., and the condition of the sample was visually observed after 50 hours.

TABLE 3

| | heat stability (150° C.) (formation of hard materials) |
|---|---|
| Formulation Example 10 | none |
| Formulation Example 11 | none |
| Formulation Example 18 | none |
| Formulation Example 20 | none |
| Formulation Example 24 | none |
| Formulation Example 25 | none |
| Formulation Example 31 | none |
| Formulation Example 32 | none |
| Formulation Example 34 | none |
| Formulation Example 36 | none |
| Formulation Example 42 | none |
| Formulation Example 57 | none |
| Formulation Example 59 | none |
| Formulation Example 60 | none |
| Formulation Example 63 | none |
| Formulation Example 64 | none |
| Formulation Example 67 | none |
| Formulation Example 68 | none |
| Formulation Example 69 | none |
| Formulation Example 70 | none |

As shown in Table 3, these fluids showed no disadvantageous results, such as formation of hard materials, after use at 150° C. and can be satisfactorily used for applications like lubricating oil.

EXAMPLE 4

Flame resistant fluids having the compositions selected as shown in Table 4 from the Formulation Examples shown in Table 1 were used. The high pressure spray burning test was conducted in accordance with the following method. The results are shown in Table 3.

(High pressure spray burning test)

A sample oil sprayed by a high pressure was ignited by a burner. After the preliminary burning was continued for 10 seconds in the presence of the flame from the burner, the flame from the burner was removed, and the time of continued burning was measured to obtain an index for the flame retardation. When the burning continued for 30 seconds or more, the test was discontinued, and the sample was rated as "continuously flammable".

Test conditions spraying pressure: 70 kg/cm$^2$G (nitrogen pressure)

temperature of test oil: 60° C.

nozzle: MONARCH 60° PL2.25 (hollow cone type)

distance between a nozzle and a burner: 10 cm time of preliminary burning: 10 seconds volume of an autoclave: 1 liter

TABLE 4

| | time of continued burning (sec) | note |
|---|---|---|
| Formulation Example 18 | 4 | not continuously flammable |
| Formulation Example 20 | 4 | not continuously flammable |
| Formulation Example 60 | 1 | not continuously flammable |
| Formulation Example 64 | 3 | not continuously flammable |
| Formulation Example 67 | 3 | not continuously flammable |

TABLE 4-continued

| | time of continued burning (sec) | note |
|---|---|---|
| Formulation Example 70 | 1 | not continuously flammable |
| commercial product* | >30 | continuously flammable |
| HG150** | >30 | continuously flammable |

*QUINTOLUBRIC (a product of QUAKER CHEMICAL Co.)
**mineral oil (500 neutral grade)

As shown in Table 4, the fluids of the present invention exhibited the excellent flame retarding property in the pin hole fire.

EXAMPLE 5

Compound B, a flame resistant fluid having the composition of Formulation Example 67, and base oil I (in Comparative Example) were used. The load bearing property and the wear property of the flame resistant fluids was evaluated in accordance with the following method. The results are shown in Table 5.

(Load bearing property)

The load at the seizure was obtained by using a friction wear tester of the FALEX type in accordance with method A in the following conditions: pin: AISI-3135, block: AISI-1137, rotation speed: 290 rpm, temperature: 25° C., preliminary load: 250 Lbs, and preliminary operation: 5 minutes. The load bearing property was evaluated from the obtained load at the seizure.

(Wear property)

For the evaluation of the wear property, the friction coefficient and the amount of wear were obtained by using a friction wear tester of the FALEX type in the following conditions: pin: AISI-3135, block: AISI-1137, rotation speed: 290 rpm, temperature: 80° C., load: 300 Lbs, and time: 30 minutes.

TABLE 5

| | load at seizure (Lbs) | friction coefficient | amount of wear (mg) |
|---|---|---|---|
| compound B | 2600< | 0.15 | 13.0 |
| Formulation Example 67 | 2200 | 0.08 | 15.8 |
| Comparative Example[1)] | 1100 | 0.06 | 40.0 |

[1)]Base oil I

As shown in Table 5, the fluids of the present invention had high friction coefficients and the excellent wearing property. Therefore, when these fluids are used as metal working oil, slipping and seizure which tends to occur in metal working can be prevented.

EXAMPLE 6

By using the fluids having the compositions shown in Table 6, the kinematic viscosity at 40° C. was obtained, and the load bearing property was evaluated in accordance with the same method as that conducted in Example 5. The results are shown in Table 6.

TABLE 6

| Formulation Example | Comparative Example | 71 | 72 | 73 | 74 |
|---|---|---|---|---|---|
| composition (% by wt.) | | | | | |
| base oil (HG 150) | 100 | 98.0 | 98.0 | 98.0 | 98.0 |
| extreme pressure additive | | | | | |
| type | — | compound B | compound D | compound E | Formulation Example 67 |
| amount | — | 2.0 | 2.0 | 2.0 | 2.0 |
| kinematic viscosity at 40° C. (cSt) | 30.08 | 29.51 | 29.29 | 29.45 | 29.83 |
| load at seizure (Lbs) | 333 | 955 | 659 | 789 | 895 |

As shown in Table 6, the compounds having the group represented by general formula (I) of the present invention had the excellent load bearing property, and are advantageously used as the extreme pressure agent for lubricating oil, metal working oil, and hydraulic oil.

INDUSTRIAL APPLICABILITY

The extreme pressure agent of the present invention does not cause environmental pollution, has an excellent property to prevent seizure under load, and is advantageously used for lubricating oil, metal working oil, and hydraulic oil. The friction coefficient modifier of the present invention has an excellent effect of increasing the friction coefficient and providing wear resistance and is advantageously used for lubricating oil, metal working oil, hydraulic oil, and the like which require such properties.

The flame resistant fluid of the present invention has a liquid state or a semi-solid state. The flame resistant fluid suppresses vaporization of flammable substances by thermal polymerization to prevent fire when the fluid is exposed to a high temperature, does not require control of the content of water, facilitates handling and waste disposal, and is advantageously used, for example, for lubricating oil, metal working oil, hydraulic oil, washing oil, heat treatment oil, and grease.

We claim:

1. A flame resistant fluid having a liquid state or a semi-solid state, which comprises a thermally polymerizable substance and at least one member selected from the group consisting of antioxidants and polymerization inhibitors, wherein said thermally polymerizable substance is a compound having in a molecule, a group represented by the formula

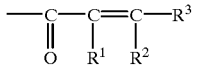

(I)

wherein $R^1$, $R^2$ and $R^3$ each independently represent hydrogen or a methyl group, and at least one of $R^2$ and $R^3$ represents a hydrogen atom, wherein the content of said thermally polymerizable substance is 15% by weight or more.

2. A flame resistant fluid according to claim 1, which comprises a base oil and a thermally polymerizable substance.

3. A flame resistant fluid according to claim 1, which has a temperature of initiation of polymerization higher than a service temperature and lower than a flash point of flammable components in the fluid.

4. A flame resistant fluid according to claim 1, wherein a temperature showing a decrease in weight of 10% is higher than a starting temperature of an exothermic curve in a differential thermal analysis.

5. A flame resistant fluid according to claim 1, which is lubricating oil, metal working oil, hydraulic oil, washing oil, heat treatment oil, electric insulating oil, or grease.

* * * * *